US008147203B2

(12) United States Patent
Chen et al.

(10) Patent No.: US 8,147,203 B2
(45) Date of Patent: Apr. 3, 2012

(54) FAN

(75) Inventors: Yi-Lin Chen, Taoyuan Hsien (TW); Ya-Hui Hung, Taoyuan Hsien (TW); Ming-Kai Hsieh, Taoyuan Hsien (TW); Li-Chen Lin, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 1101 days.

(21) Appl. No.: 12/022,043

(22) Filed: Jan. 29, 2008

(65) Prior Publication Data

US 2008/0219845 A1 Sep. 11, 2008

(30) Foreign Application Priority Data

Mar. 6, 2007 (TW) ..... 96107618 A

(51) Int. Cl.
*F01D 1/02* (2006.01)

(52) U.S. Cl. ..... 416/204 R; 416/244 R; 415/213.1; 415/214.1; 415/220

(58) Field of Classification Search ..... 415/213.1, 415/214.1, 220; 416/204 R, 244 R
See application file for complete search history.

(56) References Cited

U.S. PATENT DOCUMENTS

| | | | | |
|---|---|---|---|---|
| 5,713,790 | A * | 2/1998 | Lin | 415/213.1 |
| 6,832,895 | B2 * | 12/2004 | Yoshioka et al. | 416/183 |
| 7,214,032 | B2 * | 5/2007 | Yu | 415/213.1 |
| 7,927,074 | B2 * | 4/2011 | Sun et al. | 416/144 |
| 2002/0094271 | A1 * | 7/2002 | Yeuan et al. | 415/208.2 |
| 2004/0141841 | A1 * | 7/2004 | Otsuka | 415/220 |
| 2004/0251000 | A1 * | 12/2004 | Chang et al. | 165/120 |

* cited by examiner

*Primary Examiner* — Igor Kershteyn

(74) *Attorney, Agent, or Firm* — Birch, Stewart, Kolasch & Birch, LLP

(57) ABSTRACT

A fan includes an impeller, a motor, a plurality of first engaging members and a plurality of second engaging members. The impeller includes a hub and a plurality of blades disposed around the hub. The motor includes a rotor housing coupled with the hub, and the motor is for driving the impeller to rotate. The first engaging members are disposed on an inner side of the top surface of the hub, and the second engaging members are disposed on the top surface of the housing. When the impeller and the rotor housing are assembled, the second engaging members are disposed corresponding to the first engaging members, so that parts of the first engaging members are engaged into and assembled with the second engaging members.

20 Claims, 3 Drawing Sheets

FAN

CROSS REFERENCE TO RELATED APPLICATIONS

This Non-provisional application claims priority under 35 U.S.C. §119(a) on Patent Application No(s). 096107618, filed in Taiwan, Republic of China on Mar. 6, 2007, the entire contents of which are hereby incorporated by reference.

BACKGROUND OF THE INVENTION

1. Field of Invention

The present invention relates to a fan and, in particular to a fan that does not involve the thermal welding process and has good thermal dissipating effects.

2. Related Art

Fans are often used to dissipate heat produced by an electronic system or device. The fan includes a motor to drive the impeller to rotate. Therefore, the combining strength and means between the motor and the impeller directly affect the reliability of the fan.

Conventionally, when the motor and the impeller are assembled together, the impeller uses several protrusions disposed on the inner surface of the hub passing through the corresponding holes formed on the rotor housing of the motor, and an additional machine is then used to perform a thermal welding process so that the protrusions are melted and full of the holes, thereby the impeller and the rotor housing of the motor are fixed.

However, the conventional thermal welding process for combining the impeller and the motor involves a heating apparatus. This requires additional time and costs. Moreover, once the thermal welding process is finished, it is difficult to separate the housing of the motor and the impeller if the blades need to be replaced. In this case, the impeller along with the housing has to be removed together. This inevitably increases the maintenance cost.

SUMMARY OF THE INVENTION

In view of the foregoing, the present invention is to provide a fan with a fixing and engaging structures that can simplify the production procedure and is convenient for rework.

In addition, the present invention is also to provide a fan that simplifies the assembly of the impeller and the motor so as to reduce the manufacturing cost, thereby providing better thermal dissipating effects.

To achieve the above, the present invention discloses a fan including an impeller, a motor, a plurality of first engaging members and a plurality of second engaging members. The impeller includes a huh and a plurality of blades disposed around the hub. The motor includes a rotor housing coupled with the hub, and the motor is for driving the impeller to rotate. The first engaging members are disposed on an inner side of the top surface of the hub, and the second engaging members are disposed on the top surface of the housing. When the impeller and the rotor housing are assembled, the second engaging members are disposed corresponding to the first engaging members, so that parts of the first engaging members are engaged into and assembled with the second engaging members.

In the fan of the present invention, each first engaging member includes a connecting portion and a hook extended from the connecting portion, and each second engaging member includes an engaging groove and a through hole disposed on the top surface of the rotor housing and separated from one another by a predetermined distance. When the impeller and the rotor housing are assembled, the rotor housing and the impeller are rotated in different directions so as to engage the first engaging members to the second engaging members, thereby combining the impeller and the rotor housing.

In the fan of the present invention, each of the first engaging members goes through the through hole of each second member, and the relative hook of each second member is inserted into the engaging groove, when the first engaging members and the second engaging members are engaged together, respectively.

In the fan of the present invention, each first engaging member has a size which is substantially the same as that of each second engaging member. The first engaging members and the hub are integrally formed as a single piece In the fan of the present invention, the rotor housing is made of a metal material. A cross section of each first engaging member is L-shaped.

In the fan of the present invention, the hub has a plurality of openings disposed on the top surface of the hub and the openings are obtained corresponding to the first engaging members, respectively. Each opening can be a circular, elliptical, rectangular shape or other shape.

In the present invention, the impeller has at least one supporting structure disposed on the inner side of the top surface of the hub, so that a gap exists between the impeller and the rotor housing.

In the fan of the present invention, when the rotor housing rotates, hot airs inside the rotor housing are dissipated via the through hole of the rotor housing, the gap and an opening of the hub to outside of the fan. The supporting structure has a shape of a strip or a closed pattern. The supporting structure and the hub are integrally formed as a single piece. The supporting structure is made of an elastic material or plastic, and the rotor housing has a cylindrical shape.

As mentioned above, the fan of the present invention uses the first engaging members of the hub of the impeller and the second engaging members of the rotor housing to allow the impeller and the motor to be assembled in a rotating way to combine the hub and the housing. In comparison with the related art, the present invention does not require an additional thermal welding procedure. This greatly simplifies the assembly of the impeller and the motor and reduces the production cost. After the fan of the present invention has been assembled, a gap exists between the impeller and the motor as a thermal-dissipating path of the motor, which can enhance the reliability of the fan.

BRIEF DESCRIPTION OF THE DRAWINGS

The present invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
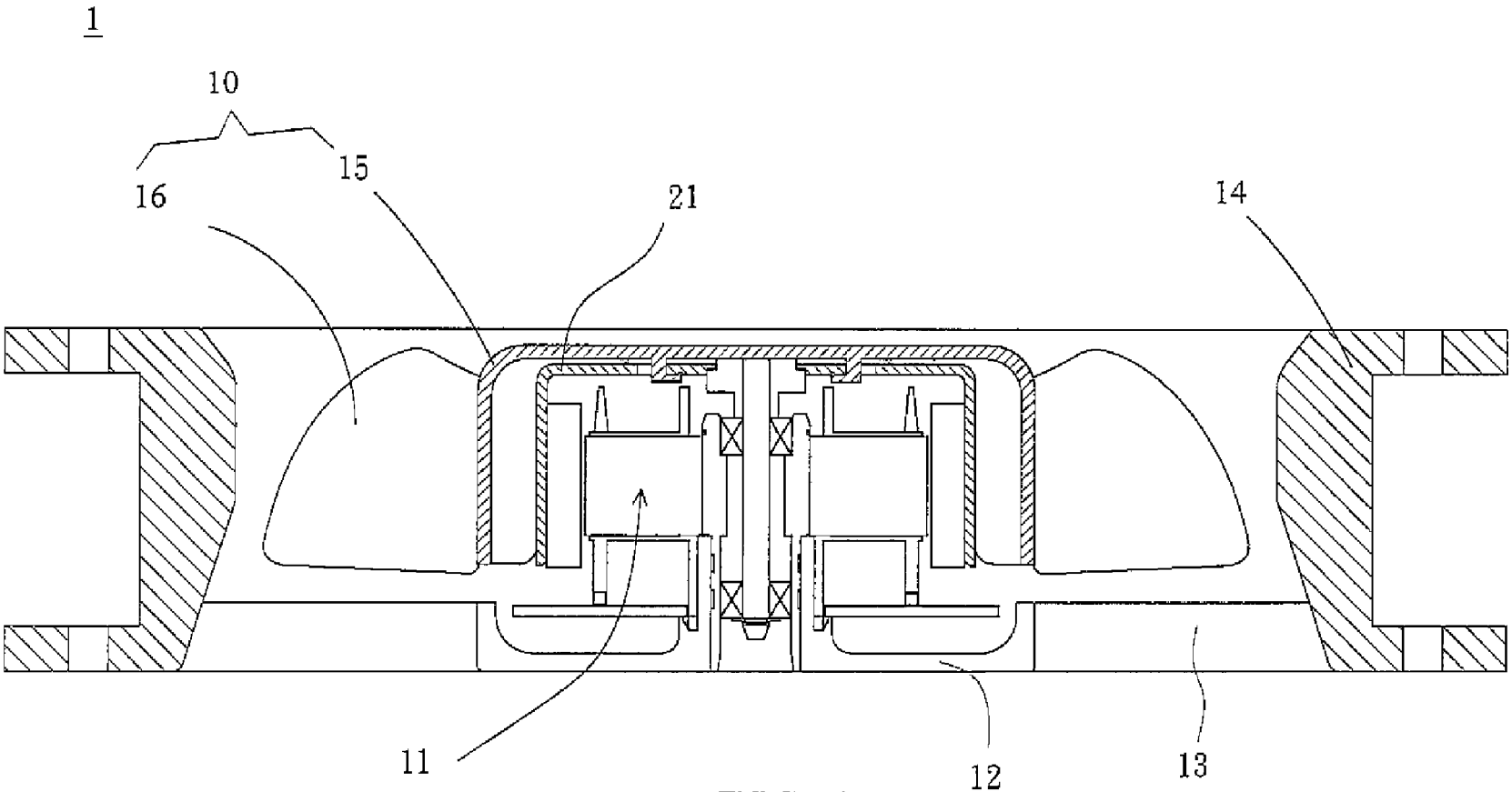
FIG. 1 is a cross-sectional view of a fan according to an embodiment of the present invention.

FIG. 1 is a cross-sectional view of a fan according to an embodiment of the present invention. Referring to FIG. 1, the fan 1 includes at least an impeller 10, a motor 11, base 12, several ribs 13, and frame 14. The motor 11 is disposed within the frame 14 and is disposed on the base 12 for driving the impeller 10 to rotate. The ribs are disposed between and connect the base 12 and the frame 14. The impeller 10 includes a hub 15 and a plurality of blades 16 disposed around the hub 15.

Figure 2:
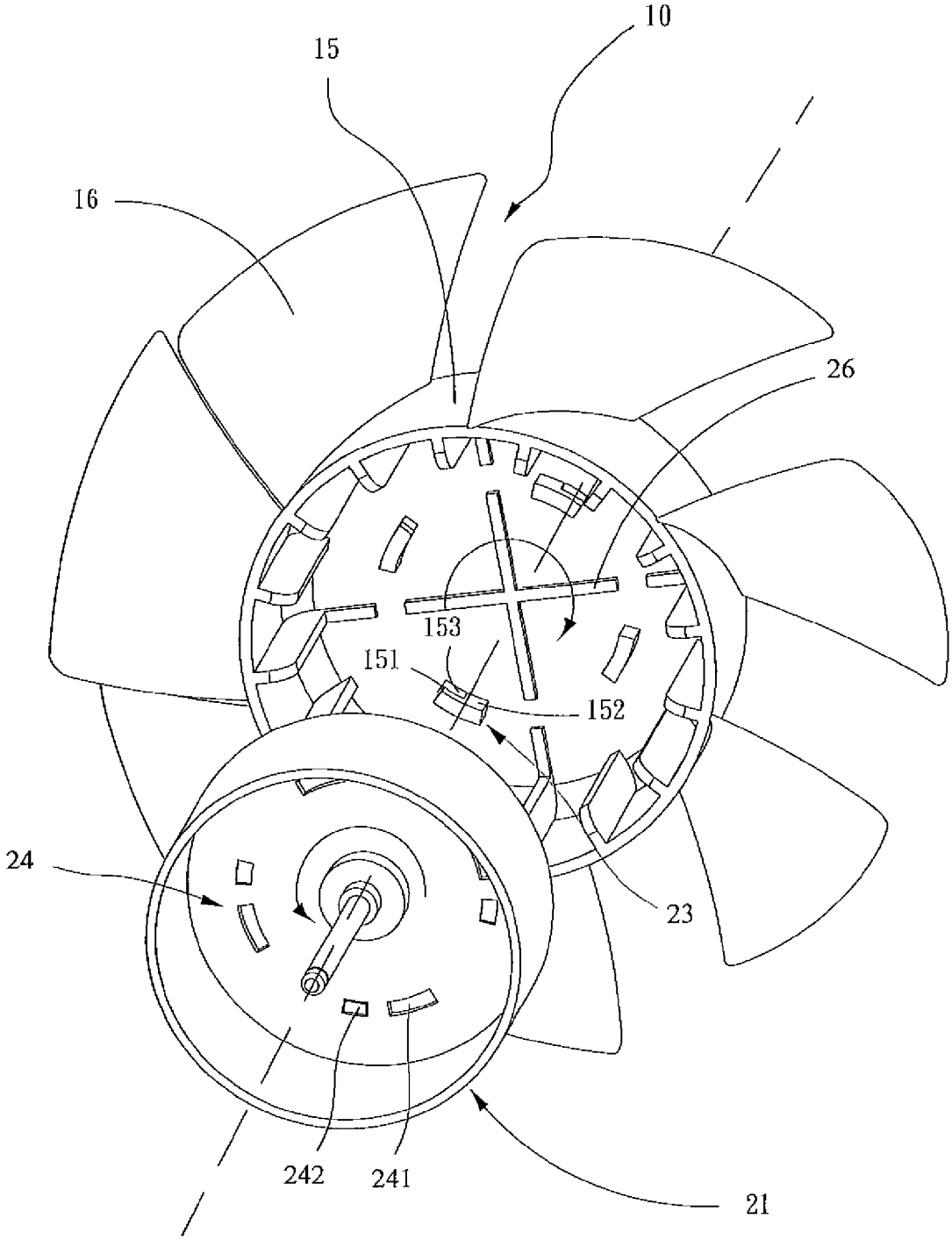
FIG. 2 is a three-dimensional view showing the impeller and the rotor housing of the fan in FIG. 1.

Referring both to FIG. 1 and FIG. 2, FIG. 2 is a three-dimensional view showing the impeller and the rotor housing of the fan in FIG. 1. The motor 11 has a rotor housing 21, which is coupled with the hub 15. The rotor housing 21 has a cylindrical shape, but not limited thereto, for example, any of bucket-like objects with different geometrical shapes are included in the scope of the present invention. Also, the rotor housing 21 is made of a metal material, for example.

In FIG. 2, the fan 1 also has a plurality of first engaging members 23 and a plurality of second engaging members 24. The first engaging members 23 are disposed on an inner side of a top surface of the hub 15, and the second engaging members 24 are disposed on the top surface of the rotor housing 21. When the impeller 10 and the rotor housing 21 are assembled, the second engaging members 24 are disposed corresponding to the first engaging members 23, so that parts of the first engaging members 23 are engaged into and assembled with the second engaging members 24. Each of the second engaging members 24 includes a through hole 241 and an engaging groove 242 formed on the top surface of the rotor housing 21 and separated from one another by a predetermined distance.

Each of the first engaging members 23 is made of an elastic material, such as, for example but not limited to, plastic. The number of the first engaging members 23 is not restricted by the present invention, but determined according to needs. The first engaging members 23 can be disposed on the inner side of a top surface of the hub 15 in a symmetric or asymmetric way with respect to a rotating center. The first engaging members 23 and the hub 15 are integrally formed as a single piece. Besides, the first engaging member 23 has a connecting portion 152 and a hook 151. The connecting portion 152 extends from the top surface of the hub 15. The hook 151 extends along a direction that is perpendicular to the connecting portion 152. The cross section of the first engaging member 23 is L-shaped. In this embodiment, the hub 15 has a plurality of openings 153 disposed on the top surface of the hub 15 and the openings 153 are obtained corresponding to the first engaging members 23, respectively. The openings 153 are formed corresponding to the hooks 151 of the first engaging members 23. The shape of each opening 153 can be circular, rectangular or of any shape.

Please further refer to FIG. 2. The impeller 10 further includes at least one supporting structure 26 disposed on the inner side of the top surface of the hub 15 and partially exposing the top surface thereof, so that a gap "d" exists between the impeller 10 and the rotor housing 21. When the impeller 10 rotates, hot airs inside the rotor housing 21 are dissipated via the through hole 241 of the rotor housing 21, the gap "d" and the opening 153 of the hub 15 to outside of the fan 1.

The supporting structure 26 and the hub are integrally formed as a single piece. The fan 1 uses this supporting structure 26 to keep a gap "d" between the impeller 10 and the rotor housing 21. In this embodiment, the shape of the supporting structure 26 is not limited to the long strip shown in FIG. 2. It can be any closed pattern, such as a circle, ellipse, rectangle or any other shape, as long as the fan 1 can achieve the required rotational balance during its operation.

Figure 3:
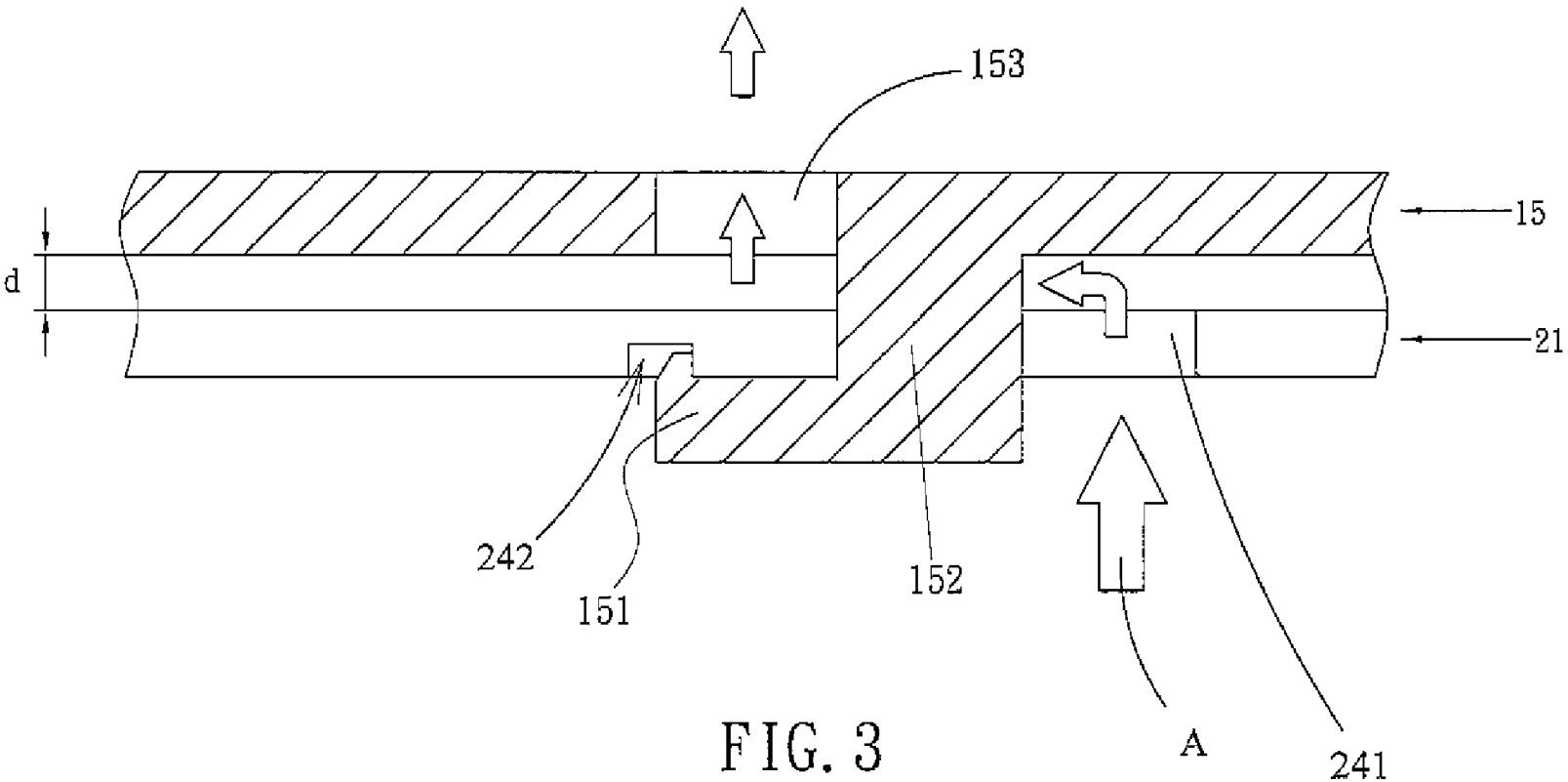
FIG. 3 is a cross-sectional view showing the thermal-dissipating path inside the fan of the present invention after the first engaging member and the second engaging member are engaged.

The assembling method of the fan of the present invention is as follows. As shown in FIGS. 2 and 3, when the impeller 21 and the motor are combined, the first engaging members 23 on the hub 15 are disposed corresponding to the second engaging members 24 on the rotor housing 21 of the motor. It should be noted that in order for the first engaging members 23 to be firmly combined with the second engaging members 24 without departure during the operation of the fan, the size of the through holes 241 on the second engaging members 24 are substantially the same as the size of the connecting portion of the first engaging members 23. After the connecting portion and the hook go through the through hole 241, the rotor housing 21 and the hub 15 of the impeller 10 are rotated in different directions so as to engage the first engaging members 23 to the second engaging members 24, thereby combining the impeller 10 and the rotor housing 21. Concurrently, the hook 151 is inserted into the engaging groove 242 to avoid the first engaging members 23 from separating and departure.

With reference to FIG. 3, during the operation of the fan 1, the motor drives the impeller 10 to rotate and thus produces hot airs in the accommodating space inside the rotor. Since the supporting structure 26 provides a gap "d" between the hub 15 and the rotor housing 21, the hot airs flow via the through hole 241 and the gap "d", and dissipates outside of the fan 1 through the opening 153 on the hub 15. The outgoing direction of the hot airs is indicated by the arrow A in FIG. 3. Consequently, as the fan 1 operates, it can also actively dissipate heat inside of the motor. Furthermore, it should be mentioned that after the assembly of the fan 1, the opening 153 on the hub 15 and the through hole 241 do not align with each other, so that dusts or objects cannot enter the motor directly. This improves the reliability of the fan 1 of the present invention.

In summary, the fan of the present invention has the following advantages Firstly, by using the first engaging members on the impeller and the second engaging members on the rotor housing, the impeller and the motor housing can be assembled in a rotating way to combine the hub and the housing. In comparison with the related art, the present invention does not require an additional thermal welding procedure. This greatly simplifies the assembly of the impeller and the rotor housing of the motor and reduces the production cost. Secondly, after the fan of the present invention has been assembled, a gap exists between the impeller and the rotor housing as a thermal-dissipating path of the motor. Moreover, the thermal-dissipating path between the impeller and the rotor housing is not a straight line so as to prevent dusts and objects from entering the motor. Thus, the fan of invention can have good reliability and thermal-dissipating effects.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

an impeller comprising a hub and a plurality of blades disposed around the hub;

a motor for driving the impeller to rotate, wherein the motor comprises a rotor housing and the rotor housing is coupled with the hub;

a plurality of first engaging members disposed on an inner side of a top surface of the hub; and a plurality of second engaging members disposed on a top surface of the rotor housing, wherein when the impeller and the rotor housing are assembled, the second engaging members are disposed corresponding to the first engaging members so that parts of the first engaging members are engaged into and assembled with the second engaging members, wherein each of the second engaging members comprises an engaging groove and a through hole disposed on the top surface of the rotor housing and separated from one another by a predetermined distance.

2. The fan of claim 1, wherein the first engaging member comprises a connecting portion and a hook extended from the connecting portion.

3. The fan of claim 1, wherein when the impeller and the rotor housing are assembled, the rotor housing and the impeller are rotated in different directions so as to engage the first engaging members to the second engaging members, thereby combining the impeller and the rotor housing.

4. The fan of claim 3, wherein each of the first engaging members goes through the through hole of each second member, and the relative hook of each second member is inserted into the engaging groove, when the first engaging members and the second engaging members are engaged together, respectively.

5. The fan of claim 1, wherein each first engaging member has a size which is substantially the same as that of each second engaging member.

6. The fan of claim 1, wherein the first engaging members and the hub are integrally formed as a single piece.

7. The fan of claim 1, wherein the first engaging members comprises an elastic material or plastic.

8. The fan of claim 1, wherein a cross section of each first engaging member is L-shaped.

9. The fan of claim 1, wherein the rotor housing comprises a metal material.

10. The fan of claim 1, wherein the hub has a plurality of openings disposed on the top surface of the hub and the openings are obtained corresponding to the first engaging members, respectively.

11. The fan of claim 10, wherein each opening has a circular, rectangular or other shape.

12. The fan of claim 1, wherein the impeller comprises at least one supporting structure disposed on the inner side of the top surface of the hub, so that a gap exists between the impeller and the rotor housing.

13. The fan of claim 12, wherein the gap existing between the impeller and the rotor housing functions as a thermal-dissipating path of the motor.

14. The fan of claim 12, wherein when the rotor housing rotates, hot airs inside the rotor housing are dissipated via the through hole, the gap and an opening of the hub to outside of the fan.

15. The fan of claim 13, wherein the opening on the hub and the through hole do not align with each other, so that dusts or objects cannot enter the motor directly.

16. The fan of claim 12, wherein the supporting structure has a shape of a strip or a closed pattern.

17. The fan of claim 12, wherein the supporting structure and the hub are integrally formed as a single piece.

18. The fan of claim 12, wherein the supporting structure comprises an elastic material or plastic.

19. The fan of claim 1, wherein the rotor housing has a cylindrical shape.

20. A fan, comprising:

an impeller comprising a hub and a plurality of blades disposed around the hub;

a motor for driving the impeller to rotate, wherein the motor comprises a rotor housing and the rotor housing is coupled with the hub;

a plurality of first engaging members disposed on an inner side of a top surface of the hub; and a plurality of second engaging members disposed on a top surface of the rotor housing, wherein when the impeller and the rotor housing are assembled, the second engaging members are disposed corresponding to the first engaging members, so that parts of the first engaging members are engaged into and assembled with the second engaging members, wherein when the impeller and the rotor housing are assembled, the rotor housing and the impeller are rotated in different directions so as to engage the first engaging members to the second engaging members, thereby combining the impeller and the rotor housing, and wherein each of the second engaging members comprises an engaging groove and a through hole disposed on the top surface of the rotor housing and separated from one another by a predetermined distance.

* * * * *